United States Patent [19]

Littleton

[11] Patent Number: 5,039,082

[45] Date of Patent: Aug. 13, 1991

[54] DOUBLE SLOW DOWN PINLESS AND GRIPPERLESS DELIVERY SYSTEM

[75] Inventor: Francis J. Littleton, Alden, N.Y.

[73] Assignee: Littleton Industrial Consultants, Inc., Alden, N.Y.

[21] Appl. No.: 349,233

[22] Filed: May 9, 1989

Related U.S. Application Data

[63] Continuation-in-part of Ser. No. 204,698, Jun. 9, 1988, Pat. No. 4,969,640, which is a continuation-in-part of Ser. No. 123,548, Nov. 20, 1987, Pat. No. 4,919,027, which is a continuation-in-part of Ser. No. 849,083, Apr. 4, 1986, abandoned.

[51] Int. Cl.[5] ..... B65H 29/68

[52] U.S. Cl. ..... 271/182; 271/202

[58] Field of Search ..... 271/182, 202, 270, 199; 148/462

[56] References Cited

U.S. PATENT DOCUMENTS

| | | | |
|---|---|---|---|
| 2,819,079 | 1/1958 | Beaulieu | 211/202 |
| 2,852,256 | 9/1958 | Faulls . | |
| 3,218,897 | 11/1965 | Geigenmiller . | |
| 3,391,777 | 7/1968 | Joa . | |
| 3,507,489 | 4/1970 | Wilshin . | |
| 3,542,362 | 11/1970 | Brockmuller et al. | 271/202 |
| 3,565,423 | 2/1971 | Kluth . | |
| 3,994,221 | 11/1976 | Littleton . | |
| 3,999,454 | 12/1976 | Tiso . | |
| 4,040,617 | 8/1977 | Walkington . | |
| 4,214,744 | 7/1980 | Evans . | |
| 4,285,513 | 8/1981 | Kwasnitza . | |
| 4,364,552 | 12/1982 | Besemann . | |
| 4,373,713 | 2/1983 | Loebach . | |
| 4,426,897 | 1/1987 | Littleton . | |
| 4,516,759 | 5/1985 | Kobler . | |
| 4,682,767 | 7/1987 | Littleton . | |
| 4,776,576 | 10/1988 | Kapoor | 271/202 |
| 4,863,154 | 9/1989 | Nirakawa et al. | 271/270 X |

FOREIGN PATENT DOCUMENTS

| | | |
|---|---|---|
| 089407 | 11/1982 | European Pat. Off. . |
| 2141340 | 2/1973 | Fed. Rep. of Germany . |
| 408060 | 9/1966 | Switzerland . |
| 1158844 | 7/1969 | United Kingdom . |
| 1208969 | 10/1970 | United Kingdom . |
| 1541562 | 3/1979 | United Kingdom . |

*Primary Examiner*—Robert P. Olszewski
*Assistant Examiner*—Boris Milef
*Attorney, Agent, or Firm*—Neuman, Williams, Anderson & Olson

[57] ABSTRACT

An apparatus for decelerating and shingling a stream of fast-moving, regularly spaced apart sheets is disclosed for use in connection with a sheet processing system. In a first portion, the sheet is subjected to a first snubbing apparatus which decelerates the sheets, thereby reducing the gap between each next subsequent sheet. In a second portion, the sheet is subjected to a second snubbing apparatus which further decelerates each sheet and allows each next subsequent sheet to overlap the previous sheet before being similarly decelerated. The speed of the sheet processing system may thereby be greatly increased.

13 Claims, 4 Drawing Sheets

DOUBLE SLOW DOWN PINLESS AND GRIPPERLESS DELIVERY SYSTEM

This is a continuation-in-part of application Ser. No. 204,698, filed June 9, 1988, now U.S. Pat. No. 4,969,640, which is a continuation-in-part of application Ser. No. 123,548, filed Nov. 20, 1987, now U.S. Pat. No. 4,919,027, which is a continuation-in-part of application Ser. No. 849,083, filed Apr. 4, 1986 and now abandoned.

BACKGROUND OF THE INVENTION

FIELD OF INVENTION

In the printing industry, and particularly in a printing process, a continuous web of paper is first passed through the printing press which makes ink impressions on the web. The moving web is then immediately passed through an oven to remove solvents and wetting solution retained from the printing process. The web is then cooled by passing it over chill rollers. The web may then pass through a sheet processing apparatus for cutting the web into separate sheets or signatures and alternately diverting or separating the individual sheets into two paths thereby creating a space between successive sheets. The continuous stream of spaced sheets are now in position for further processing.

The present invention relates to an improved system for decelerating and shingling or overlapping a stream of fast-moving, spaced apart sheets. The present invention employs a first deceleration portion which decelerates and reduces the gap between successive sheets and then further decelerates and shingles or overlaps the successive sheets for delivery of the sheets to a subsequent process such as a sheet counter or stacker system as described in my U.S. Pat. No. 4,652,197. The present invention provides an improved delivery system which maintains continuous, positive control over the sheets while the sheets are decelerated and also as they are shingled in preparation for delivery to a subsequent processing station. Critically, the present invention provides an improved delivery system which operates at a dramatically increased speed with respect to present delivery systems thereby allowing the overall printing operation to operate at an increased speed. The present invention operates equally well with signatures which are one sheet thick or with signatures which are several sheets thick such as pamphlets, magazines or newspapers.

Various delivery systems for decelerating and shingling sheets are set forth in the prior art. While printing presses operate at high speeds, it has always been necessary to reduce the speed of the sheets in the delivery system both to shingle and to square the sheets. Squaring the sheets may be achieved by allowing the lead edge of each sheet to strike a fixed object such as a squaring roller. However, to avoid permanent damage to the sheets, particularly single or lightweight sheets, the paper should not be travelling faster than about 300 feet per minute when squaring sheets. This limitation is a physical characteristic of most normal weight paper and, consequently, limits the overall output of the printing system by necessitating a reduced operating speed for the delivery system.

One delivery means known in the art operates in combination with opposed knife cylinders, each of which is 180° out of phase with the knife edge of the other cylinder. These knife cylinders include a row of cam operated pins which pierce and grip the web and then deliver the cut sheet to an associated delivery cylinder. Each delivery cylinder includes a cam operated gripper that grabs the leading edge of the cut sheet as the pins in the knife cylinder are withdrawn and deposits the cut sheets in a shingled fashion on a delivery conveyor system. As each successive sheet is laid down in a shingled format on the respective delivery conveyors, the gripper of the delivery cylinder releases the sheet. However, operations such as these create a great deal of wasted paper because the sheet edges must be subsequently cut in order to remove the pin holes. Moreover, the need to cut the edges adds a further processing step to the overall system which increases the time to produce a finished product and increases the costs.

Another prior art delivery system employs a fan like element to shingle the sheets. By means of gravity, sheets are caused to fall into a receptive slot in a rotating fan-like delivery means. As the delivery means rotates the sheets fall out one after the other in an overlying or shingled arrangement. However, once a sheet has entered the fan delivery, the timing of the entire delivery system is subject to the gravitational forces working on the sheet. As a result, lightweight sheets could severely slow down a system otherwise capable of operating at higher speeds. The delivery system of the present invention improves upon this arrangement by maintaining continuous and positive control of each and every sheet, which this prior art system cannot do, and by increasing the operating speed with respect to this prior art system.

Other prior art delivery systems employ rotary knock down arms for decelerating the sheets but still require squaring rollers for aligning the sheets. While the knock down arms, by acting on the tail of the sheets, are an improvement over the use of fixed stops in decelerating the sheets, critical speed limitations are still present because of the squaring roller. Moreover, the knock down arm merely strikes the rapidly moving sheet throwing the sheet against a lower, slow speed belt. Because the sheet is unrestrained at this time the chance of it becoming misaligned or out of square is great.

An improvement over that system is disclosed in my U.S. Pat. No. 3,994,221. While still using a squaring roller, the deceleration procedure is improved by the use of a series of freely rotating snubber wheels mounted on rotating snubber support plates. Instead of only knocking the sheet down, allowing it to bounce onto a lower, slow speed belt, the snubber wheels physically trap the tails of the sheets against the slow speed belt while the lead edges of the sheets engage the squaring roller. This causes the sheets to decelerate more quickly but can still allow a misalignment. Consequently a squaring roller is still needed and still places a speed limitation on the system. However, this system is limited in its operating speed; at best, it can only handle a few pages of light weight stock travelling approximately 1800 feet per minute. Of course, heavier sheets can be handled at higher speeds.

The present invention overcomes all of the aforementioned problems by maintaining a positive control over the sheets during the decelerating process and during subsequent delivery. Specifically, as the sheets exit opposed, high-speed belts in a spaced format, a first slowdown section decelerates the sheets by employing snubber arcs to trap the individual sheets against lower, intermediate speed belts while the tail of the sheets are still engaged by or just exiting the opposed high-speed belts. While this may create a slight overfeed of the tail end of the sheets, it is not significant enough to permanently crease the sheets. This process reduces the gap between successive sheets and decelerates the sheets to the speed of the intermediate speed belts. The sheets are then delivered to a second decelerating process where snubbers trap the individual sheets against the lower, slow speed belts while the tails of the sheets are still engaged by the opposed intermediate speed belts. By decelerating the sheets in multiple slow down stages, the overall web speed can be increased and improve the speed of the printing operation. In addition, by maintaining positive control over the sheets, the sheets are never allowed to become unaligned. Thus, the continual positive control allows removal of squaring rollers which, in turn, allows the system to operate at a higher speed.

SUMMARY OF THE INVENTION

In accordance with one embodiment, a sheet handling or delivery system receives a fast moving stream of regularly spaced apart sheets from a sheet processing apparatus. The sheet handling system decelerates the sheets and ultimately places the sheets in a shingled format. In a first stage, a first conveyor system includes a conveying surface that is aligned with the sheet path exiting the sheet processing apparatus and is dropped relative to the path of the sheet processing apparatus. A first snubbing means is positioned near the upstream end of the conveyor system and includes a plurality of aligned snubber arcs which are mounted on a common axis of rotation in overlying relation to the sheet path conveying surface. The first snubbing means traps each of the sheets exiting the sheet processing apparatus against the conveying surface so that each sheet is decelerated to the speed of the conveying surface. The snubber arcs are timed with respect to the arrival of the sheets so that each sheet is trapped against the conveying surface substantially immediately as the tail of the sheet exits the sheet processing apparatus. Thus, the sheet is not in free flight for any significant interval after the tail of the sheet exits the sheet processing apparatus.

In the preferred embodiment, the first snubbing means comprises curved snubber arcs mounted 180° apart from counterbalance weight members.

In a subsequent stage, the sheet handling system includes a second conveyor system positioned downstream of the sheet processing apparatus. The second conveyor system includes a second conveying surface aligned with the sheet path of the first conveying surface and operates at a speed substantially reduced from the speed of the first conveying surface. The second conveying system further includes a third conveying surface positioned in substantially overlying relation with respect to the second conveying surface. The third conveying surface operates at substantially the same speed as the first conveying surface and cooperates with the first conveying surface to form an adjustably positionable nip at the termination of the first conveyor system and the beginning of the second conveyor system. The nip receives the leading edge of a sheet before the tail of the sheet is released by the first snubbing means. Thus, the sheet remains positively controlled as it exits the first snubbing means.

The second conveying system further operates as a final deceleration stage for further decelerating the sheets and placing the sheets in a shingled format. The second conveyor surface, positioned downstream from the first conveyor surface, is dropped relative to the path of the stream of sheets exiting the nip formed by the first and third conveying systems. A second snubbing means, positioned near the upstream end of the second conveyor surface, traps the incoming sheets against the second conveying surface. Each sheet is thereby decelerated to the speed of the second conveying surface. The second snubbing means is mounted on a second axis of rotation in overlying relation to the second sheet path conveying surface. Preferably, each second snubbing means comprises a pair of snubber rollers, spaced 180° apart, which alternately engage successive sheets and trap them against the second conveying surface operating at a significantly reduced speed in comparison to the speed of the sheets entering the sheet handling system.

A particular advantage of the present invention is that, with multiple slow down stages, the speed of the sheet processing apparatus may be increased. In particular, the sheet handling system can accept sheets travelling up to 2400–3000 feet per minute depending upon the weight and number of sheets and still decelerate and shingle the sheets without damaging the individual sheets.

It should be understood that the drawings are not necessarily to scale and that an embodiment is sometimes illustrated by fragmentary views. In certain instances, details of the actual structure which are not necessary for the understanding of the present invention may have been omitted. It should be understood, of course, that the invention is not necessarily limited to the particular embodiments illustrated herein.

DETAILED DESCRIPTION OF THE PREFERRED EMBODIMENT

Generally, the present invention relates to a sheet delivery and deceleration system for use in a printing system. In the preferred embodiment, the present invention is used in combination with a sheet diverting system which alternately diverts the individual sheets into two paths, thereby creating a space or gap between successive sheets. However, the present invention can be utilized in any situation where a stream of sheets are arranged in a spaced format. The present invention decelerates the sheets through two slow down stages and shingles successive sheets for delivery to a subsequent processing station. This invention is intended to be integrated into a full service printing system, and will supply shingled sheets of printed material to a subsequent processing station such as a counting and stacking operation.

Figure 2:
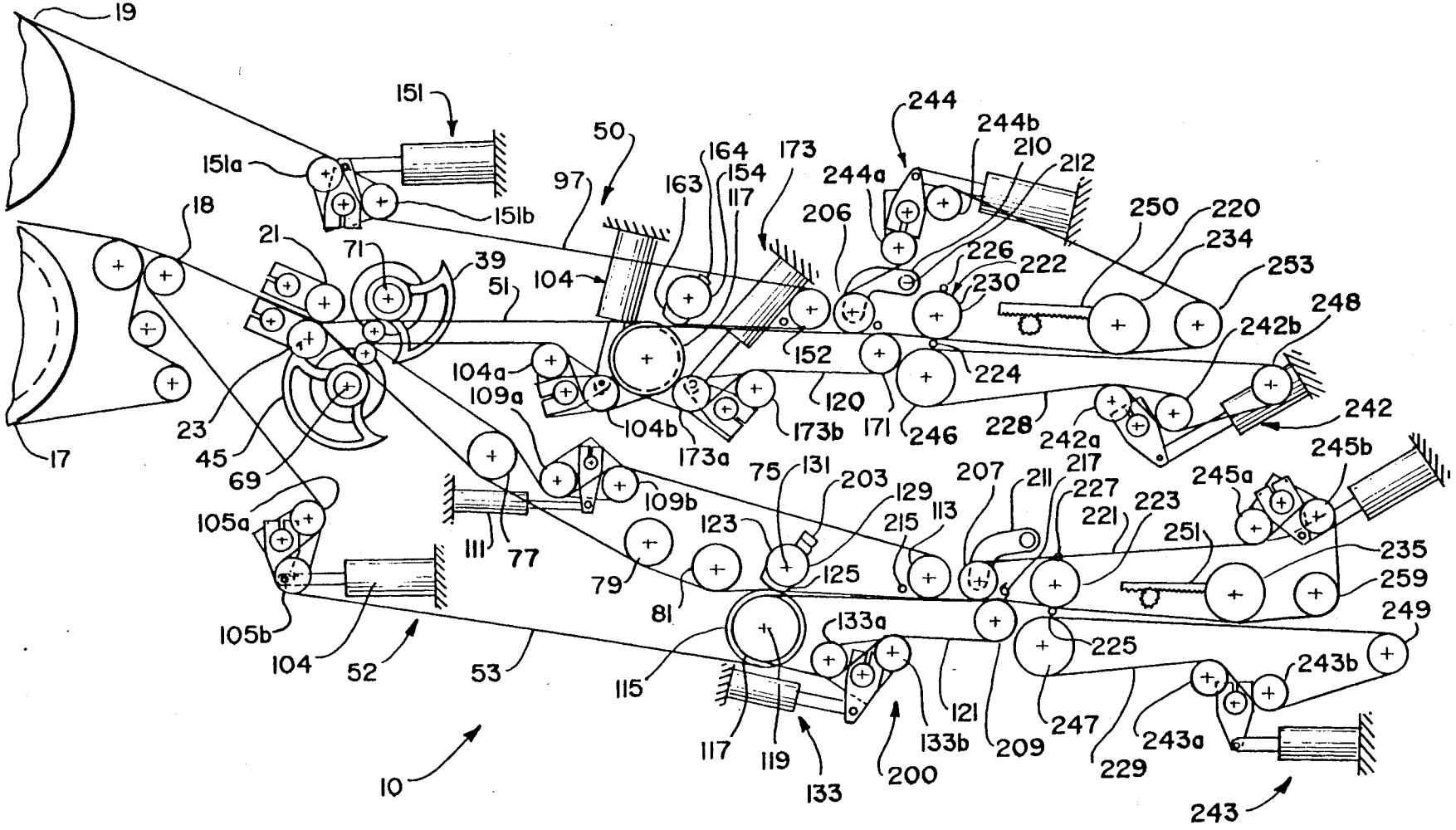
FIG. 2 is a detailed cross sectional view of the primary elements of the sheet diverter and delivery system.

Referring now to FIG. 2, the sheet delivery system 10 of the present invention is shown. Much of the frame structure is not shown to more clearly illustrate the belt and roller configurations of the delivery sections. The diverting section and the cutting operation, described in connection with the preferred embodiment of the present invention, is fully set forth in and described in my pending application ser. no. 123,548. A summary of the cutting operation and the sheet diverting system is given as an aid to the understanding of the present invention. However, the embodiment described below is simply an example of the invention and the invention is not limited to this embodiment.

In the sheet diverting system, opposed guide rollers (not shown) draw a continuous web of paper (not shown). Prior to the present invention, the guide rollers operated at a speed of approximately 1800 feet per minute for lightweight paper due to the maximum speed limitation imposed by the sheet delivery system. The leading edge of the web passes between the anvil cylinder 17 and the rotary knife cylinder 19 and engages a second pair of opposed guide rollers 21 and 23, creating tension in the portion of the web between the first set of guide rollers (not shown) and opposed guide rollers 21 and 23. As the web is held firmly in place and under tension, one of the four blades of rotary knife cylinder 19 rotates into position and cuts a sheet from the web.

Power can be supplied to the anvil cylinder 17, and consequently the rest of the diverter and delivery system, from a printing press (not shown) through either drive gears or timing belts (not shown). In the preferred embodiment, appropriate timing belts and pulleys are interconnected throughout the system to achieve proper timing of the system as is well known in the art. Of course, the diverting and delivery system could just as easily be driven by an appropriate gear train. By being directly driven by the printing press, proper timing between the respective sections of the operation is ensured.

Figure 1:
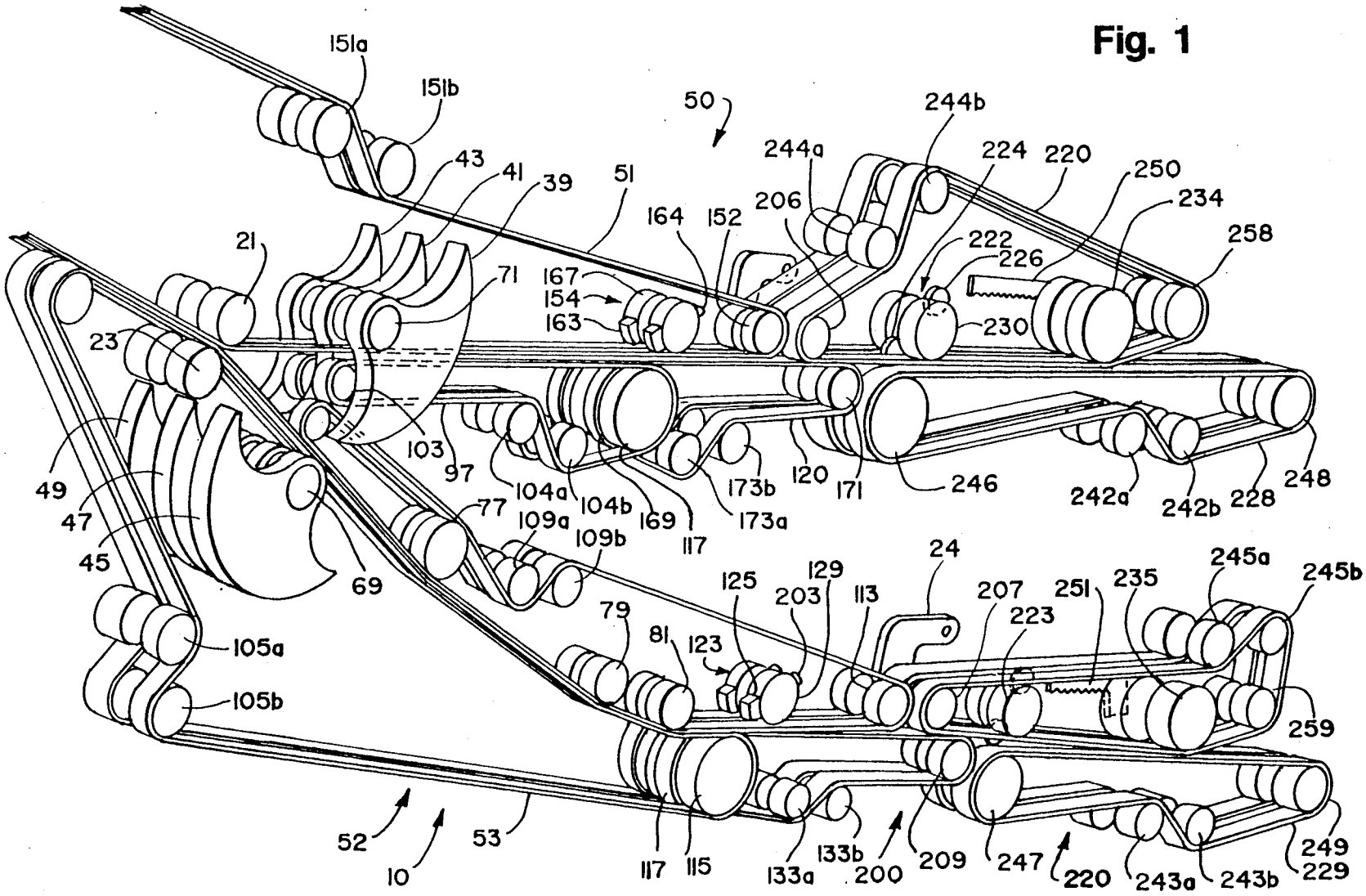
FIG. 1 is a perspective view of a sheet diverter and delivery system with much of the structure removed for clarity.

After the sheet is cut from the web, opposed guide rollers 21 and 23 continue to draw the sheet until it contacts either the rotating upper diverting cams 39, 41 and 43 or the lower diverting cams 45, 47 and 49. As best seen in FIG. 1, the rotating diverting cams are positioned and synchronized so that sheets are alternately directed toward either an upper delivery high speed system 50 or a lower delivery high speed delivery system 52. Of course, lower camshaft 69 and upper camshaft 71 may be provided with suitable clutch means, thereby acting as jam detectors. Such clutch means are well known to one skilled in the art.

The elements of the upper high speed delivery system 50 and the lower delivery system 52 are functionally the same. For purposes of simplicity, only the lower delivery system 52 will be described in detail; it being understood that the upper delivery system utilizes corresponding elements and functions in the same manner. In addition, though the system is illustrated and described herein using pairs of belts traversing various driver or idler rollers, it should be understood that the invention may provide more than two belts depending on the width of the sheets of paper and the desired application and that a single rotating shaft could be used for all the belts rather than individual rollers.

The lower, high speed delivery system 52 includes a pair of lower high speed belts 53 and a pair of upper high speed belts 75. Lower guide rollers 23 and idler rollers 18 are part of the conveyor system defined by lower high speed belts 53. The initial idler rollers 77 and idler rollers 79 and 81 of the high speed delivery system 52 are rotatably mounted to the frame of the system (not shown). The idlers rollers are disposed to position the belts along the outer edges of the sheets. In this way, the sheet edges are always supported to avoid becoming torn or possibly jamming the system.

The lower high speed belts 53 are subject to constant tensioning by belt tensioning member 107 through tensioning rollers 105*a* and 105*b* described in greater detail hereinafter. Likewise, tensioning rollers 109*a* and 109*b* and multiple belt tensioner 111 provide tensioning to the upper high speed belts 75.

A pair of drive rollers 113 define the termination of the conveyor system defined by upper high speed belts 75. Drive rollers 115 define the termination of lower high speed belts 53. Of course, one of skill in the art will understand that a single shaft supporting both high speed belts would work just as well and could replace any of the pairs of rollers described herein.

A sheet destined for the lower high speed delivery system 52 will pass between the pair of opposed nip rollers 21 and 23 and will be positively controlled therebetween until the upper rotating diverting cams 39, 41 and 43 contact the sheet and guide it against the pair of lower, high speed belts 53. The sheet is released by diverting cams 39, 41 and 43 only after the sheet has been positively engaged between opposed belts 53 and 75.

Once a sheet has been diverted into the lower high speed delivery system 52, lower diverting cams 45, 47 and 49 rotate into position to guide the next succeeding sheet exiting opposed nip rollers 21 and 23. This next sheet will be positively guided and supported by cams 45, 47 and 49 against upper, high-speed belts 51 and 97. Thus, the continuous stream of sheets is alternatively delivered between the upper high speed delivery system 50 and the lower high speed delivery system 52. By alternately diverting each sheet in this manner, each sheet is separated from the next sheet by a distance at least as great as the length of a sheet in the lower delivery system 52. This gap allows the delivery sections to function.

Figure 3:
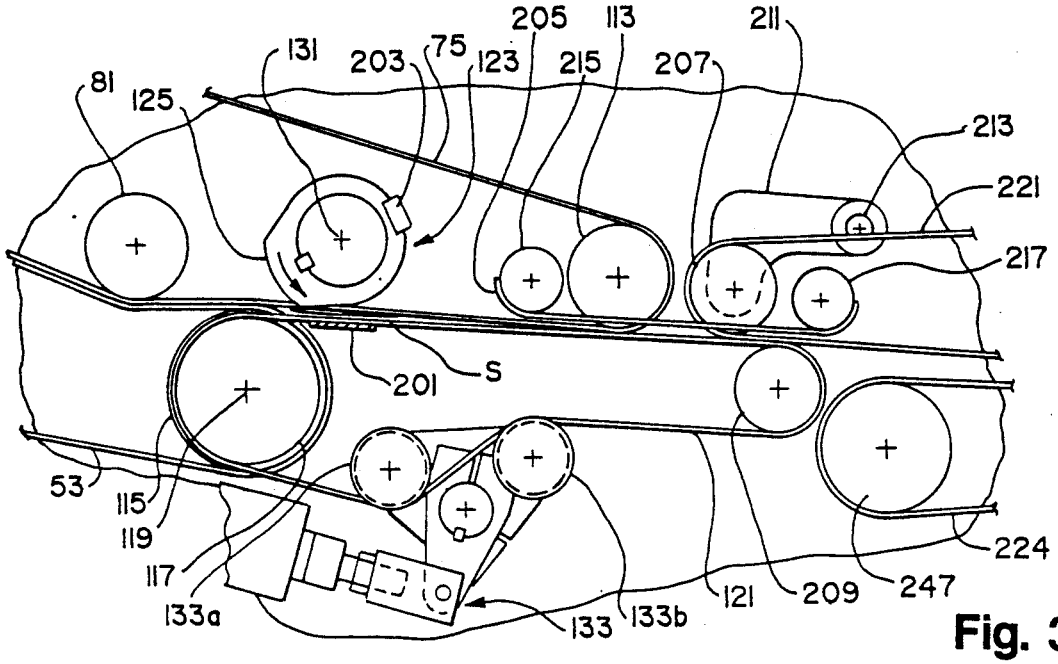
FIG. 3 is a detailed cross sectional view which illustrates the operation of the first sheet slow down section of the present invention.

As best shown in FIG. 3, the sheets emerge from between the lower, opposed high speed belts 53 and 75 and are engaged by a first slow-down system 200 which promptly decelerates the sheets and thereby reduces the gap between each sheet. First slow-down system 200 includes a lower intermediate speed conveyor system defined by a pair of lower, intermediate speed belts 121. The intermediate speed belts 121 traverse a pair of idler rollers 117, which freely rotate about the same axis 119 as high speed drive rollers 115, and drive rollers 209. The belts 121 are subject to constant tensioning with tensioning rollers 133*a* and 133*b* provided by multiple belt tensioner 133 further described hereinafter.

The sheet exiting the nip formed between the opposed, high-speed belts 53 and 75 tends to adhere to the lower surface of the continuing upper belts 75 because each of these upper belts are declined at an angle of approximately three degrees rather than being parallel to the ground. The lower, intermediate-speed belts 121 are disposed below the upper, high-speed belts 75, but are spaced from the high-speed belts 75. These lower, intermediate speed belts 121 may also be declined at an angle of approximately three degrees. Belts 121 move at a speed approximately two-thirds the speed of high speed belts 53 and 75, or at approximately 1470 feet per minute.

Figure 4:
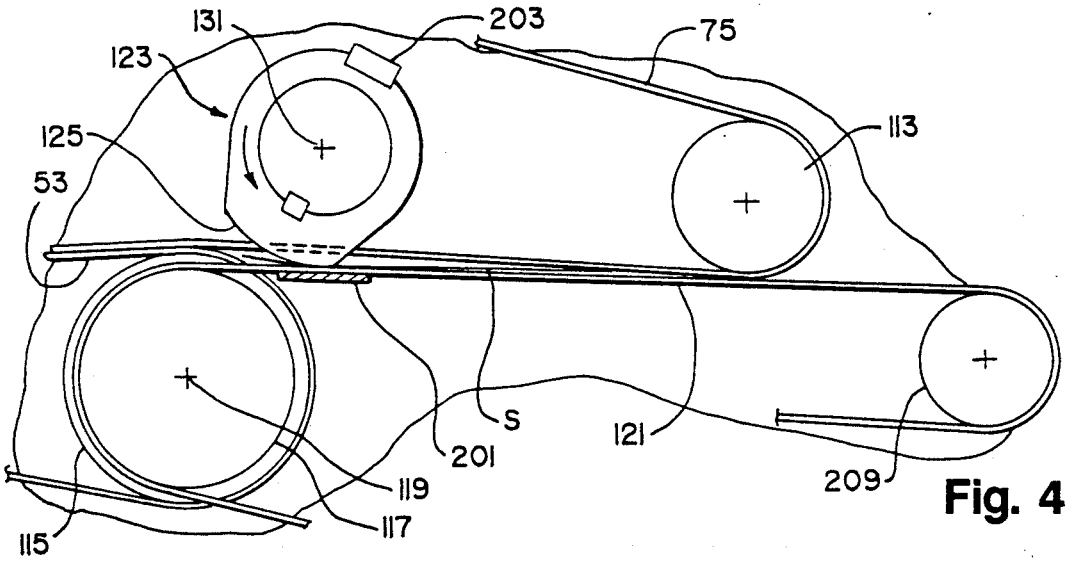
FIGS. 4 and 5 illustrate in greater detail the operation of the sheet snubber assemblies associated with the first slow down section.
Figure 5:
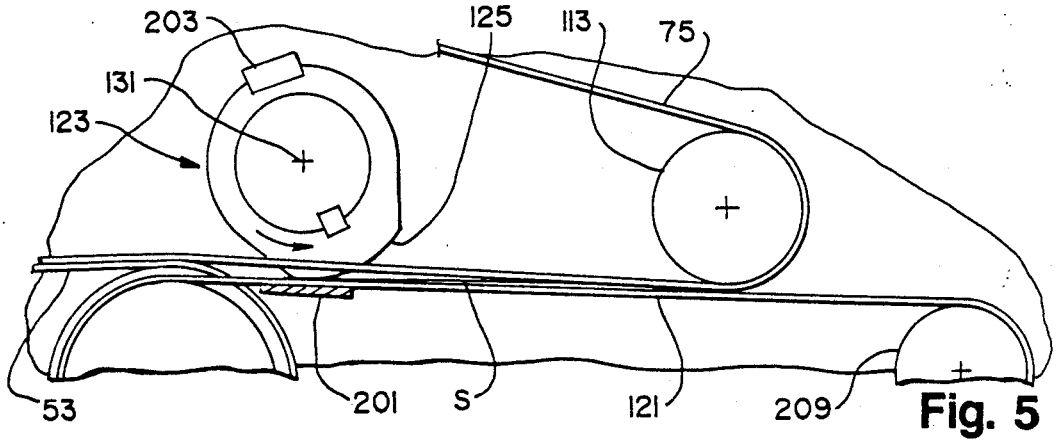

As best seen in FIGS. 4 and 5, the sheets are decelerated by means of a plurality of snubber assemblies 123 each comprised of a snubber arc 125 mounted to snubber a support plate 129. In the preferred embodiment, snubber arc 125 is a curve-shaped member. A weighted member 203 counterbalances snubber arc 125 and is mounted opposite snubber arc 125 on snubber support plate 129. It has been found that the snubbing means may alternatively include a pair of snubber wheels freely rotatable on snubber support plate 129 as described in greater detail in connection with the second slow down section.

The snubber support plates 129 are mounted to a snubber shaft 131, a common axis for rotation for the snubber assemblies 123. The surface speed of snubber arc 125 is approximately the same as lower intermediate speed belts 121. Snubber shaft 131 is also timed with respect to knife cylinder 19 so that one sheet will be introduced to the snubber assemblies 123 for every revolution of the snubber assemblies 123. In the arrangement wherein the snubbing means includes a pair of snubber wheels, two sheets will be introduced to the snubber assemblies 123 for every revolution of the snubber assemblies 123.

During the initial slow-down stage, the lead edge of sheet S passes through snubbing means 123 and tends to adhere to upper high speed belts 75 which continue downstream of snubbing means 123. Snubber arc 125 then engages sheet S substantially near its tail, pressing sheet S on the lower, intermediate speed belts 121, thereby decelerating sheet S. Snubber arc 125 rotates at approximately the same speed as lower, intermediate speed belts 121. A deckplate 201, may be positioned beneath lower, intermediate speed belts 121 to provide a solid platform against which snubber arcs 125 can trap the respective sheets. Without deckplate 201, the snubbers trap the sheets against the unsupported, intermediate speed belts, which may lead to undesirable bouncing of the intermediate speed belts during operation. Thus, the tension in the lower, intermediate speed belts 121 must be regulated by a tensioning member 133 through tensioning rollers 133*a* and 133*b* to provide sufficient opposing support during snubbing.

It is important that the actual snubbing of sheet S occurs while the tail of sheet S is still trapped between or has just immediately left opposed high speed belts 53 and 75. This continuous positive control of the sheets ensures that the sheets will not become misaligned and potentially foul or jam the system.

As the tail of sheet S is decelerated and snubbed against lower, intermediate speed belts 121, the lead edge of sheet S remains on the lower surface of upper high speed belts 75. In this regard, it is important that the upper, high speed belts 75 and lower, intermediate speed belts 121 are not substantially spaced apart to prevent the sheet edges from lifting up, flapping or becoming creased or folded. Thus, the upper, high speed belts 75 are preferably placed approximately ⅛ of an inch above the lower, intermediate speed belts 121.

Figure 6:
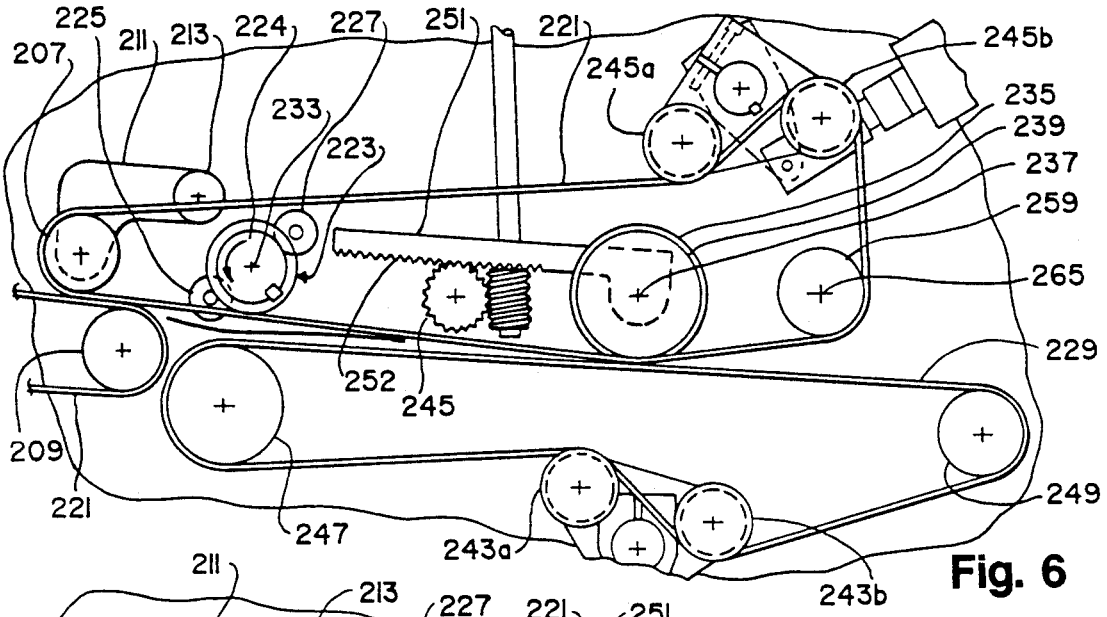
FIG. 6 is a detailed cross sectional view of the second slow down section of the present invention.

As shown in FIG. 6, a pair of lower drive rollers 209 terminate the lower, intermediate speed conveyor system and generally mark the beginning of a second conveyor system. The second conveyor system includes a pair of upper, intermediate speed belts 221 having at least a portion disposed above the lower intermediate speed belts 121. The upper, intermediate speed belts 221 traverse a pair of adjustably positionable idler rollers 207 and a pair of drive rollers 259. Drive rollers 259 are rotatable about axis 265.

The downstream portion of the lower, intermediate speed belts 121 and the upstream portion of the upper, intermediate speed belts 221 form a nip adjustably positionable along the path of sheet flow to accommodate sheets of varying length. The nip captures the lead edge of sheet S before the tail of sheet S leaves snubbing means 123, maintaining positive control on sheet S.

Adjusting rollers 207 may be adjusted to insure that different lengths of sheets are nipped by intermediate speed belts 121 and 221. Adjusting rollers 207 are adjustably positionable by arm 211 about pivot 213. In this regard, adjusting rollers 207 adjust the gap between intermediate speed belts 221 and 121. To accommodate a larger sheet S, arm 211 pivots upwardly, urging adjusting rollers 207 and intermediate speed belts 221 away from intermediate speed belts 121. Thus, the lead edge of a larger sheet S is actually nipped by intermediate speed belts 221 and 121 downstream from snubber arcs 125. In the preferred embodiment, adjusting rollers 207 may be adjusted to accommodate sheet lengths varying between 10½ inches to 11⅜ inches.

As most easily seen in FIG. 3, a gap exists between the conveyor system defined by upper, high speed belts 75 and the conveyor system defined by upper, intermediate speed belts 221. To avoid sheets from becoming drawn into this gap, thereby jamming the system, the preferred embodiment includes a deflecting plate 205 which closes the gap and maintains a continuous path for the lead edge of sheet S. Plate 205 is dimensioned to extend at least the width of belts 75 and 221 to maintain control of the outside edge of sheet S. Controlling rollers 215 and 217 may be positioned near the curved ends of plate 205 to insure control of sheet S.

Once the sheet passes through the nip formed between intermediate speed belts 121 and 221, the sheet is fed to a second deceleration and shingling system 220. For this second deceleration system to function, a gap must exist between successive sheets. The size of this gap is determined by the amount of slowdown in the first slow down stage. Preferably, a gap of at least 2½ inches should be maintained after the first slowdown section to prevent a possible jam occurring in the second slow down stage.

A pair of low speed belts 229 define a low speed conveyor system. This low speed conveyor system begins downstream of the terminating end of lower, intermediate speed belts 121 and is dropped relative to the plane of lower, intermediate speed belts 121. Low speed belts 229 traverse a pair of idler rollers 247 and drive rollers 249, which drive low speed belts 229 at a speed depending on the web speed and the desired amount of overlap between successive sheets.

As in the first slow down stage, the sheet exiting the nip formed between opposed intermediate speed belts 121 and 221 tends to adhere to the lower surface of continuing upper, intermediate speed belts 221 since each of these upper belts is also declined at an angle of approximately three degrees. The tail of exiting sheet S is decelerated by snubber assemblies 223, each comprised of a pair of snubber wheels 225 and 227 freely rotatable on the snubber support plates 224. The snubber support plates 224 are mounted to a common axis snubber shaft 233 that is timed with respect to knife cylinder 19 so that two sheets will be introduced to the snubber assemblies 223 for every revolution of the snubber assemblies 223.

Figure 7:
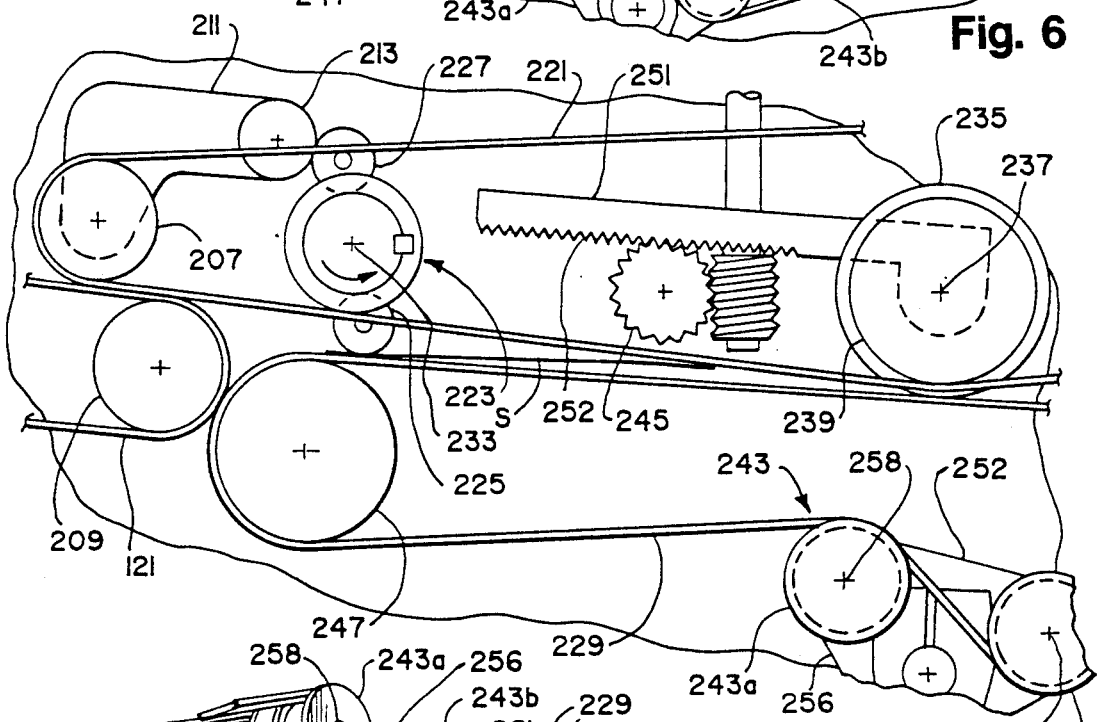
FIG. 7 illustrates in greater detail the operation of the sheet snubber assemblies associated with the second slow down section.

As best seen in FIG. 7, the snubber wheels 225 or 227 engage the tail of the incoming sheet and strip the rear portion of the sheet from the upper, intermediate speed belts 221. As sheet S continues forward and the snubber support plates 229 continue to rotate, the sheet is pressed against the low speed belts 229, thereby decelerating the sheet. Because the snubber wheels 225 and 227 are freely rotatable, they are free to adapt to the speed of the snubbed sheet S and the sheet is undamaged during its second deceleration. Snubber wheels 225 and 227 are preferably manufactured from resiliently deformable or compressible material, such as rubber, to further prevent damage to the sheets upon impact of low speed snubbers 225 and 227.

While the preferred snubbing means in the second slow down section includes snubber wheels, the invention may provide for snubber arcs and counterbalance weight members as described in connection with the first slow down section. In this arrangement, one sheet will be introduced to the snubber assemblies 223 for every revolution of the snubber assemblies 223.

Snubber wheels 225 and 227 snub the sheets against low speed belts 229 slightly before the lowest point of their rotation. Consequently, a belt tensioning member 243 is needed to maintain the appropriate tension in low speed belts 229. In the preferred embodiment, the belt tensioning member 243 includes a plurality of tensioning rollers **243*a* and 243*b* in rotational contact with low speed belts 229. The belts are subject to constant tensioning through the tensioning rollers 243*a* and 243*b* provided by the belt tensioning member 243 and described in greater detail hereinafter. Similarly, belt tensioning members 133 and 245 provide adjustment of intermediate speed belts 121 and 221 respectively. Of course, any other suitable tensioning device can be used to control the tension in intermediate speed belts 121 and 221 and low speed belts 229**.

Once the tail of sheet S has been decelerated by the low speed snubbers, it is now laid flat against the low speed belts 229 and is traveling at the reduced speed of the low speed belts. For example, sheet S may be travelling at a linear speed of about 163 feet per minute. Simultaneously, the snubber wheels 225 are lifting off the sheet and the next subsequent sheet is emerging between opposed intermediate speed belts 121 and 221. The snubber support plates 224 continue their rotation and the second snubber wheels 227 now positively guide and trap the next subsequent sheet in the manner previously described. However, the next subsequent sheet, traveling at a higher speed, is caused to overlap the previous sheet thereby achieving the desired shingling of the sheets. The length of the overlap is determined by the speed of the low speed belts 229.

Despite the snubbing, the lead edge of sheet S may continue to adhere to upper, intermediate speed belts 221. Consequently, in the preferred embodiment, a plurality of squaring rollers 235 straighten the sheet and press the front edge of the sheet onto low speed belts 229. Squaring rollers 235 are freely rotatable about axis 237 which is disposed at the downstream end of arm 251. Positioning rollers 239, also rotatably mounted on axis 237, cooperate with upper, intermediate speed belts 221 to provide vertical adjustable positioning of squaring rollers 235. The squaring rollers 235 can be vertically adjusted by adjusting the tension in belts 221. Arm 251 further includes gear rack 252 which cooperates with pinion 245 to provide longitudinal positioning of the squaring rollers 235 along the path of sheet flow. Thus, squaring rollers 235 and tensioning rollers 239 are vertically and horizontally adjustable to accommodate different weights, lengths and thicknesses of paper.

The elements of the upper diverter and delivery system are functionally the same as the corresponding elements described previously with respect to the lower diverter and delivery system, although the elements of the upper system are not shown in detail.

Turning back to FIG. 1, as a sheet emerges from the opposed front guide rollers 21 and 23, the lower diverter cams 45, 47 and 49 guide the sheet against upper high-speed belts 51 and support the sheet against the upper, high speed belts 51 until the sheet totally passes between the opposed, high speed belts 51 and lower, high-speed belts 97 of the upper delivery section. The upper, high speed belts 51 and the lower, high speed belts 97 deliver the sheet to the first snubbing area of the upper delivery system 50. The upper, high speed belts traverse several idler rollers (not shown) and a driving roller 152. A belt tensioning member 151 (FIG. 2) provides tension to the upper, high-speed belts 51 through tensioning rollers **151*a* and 151*b*. The lower, high-speed belts traverse idler rollers 103 and drive rollers 117. A belt tensioning member 104 (FIG. 2) provides tension to the lower, high-speed belts 97 through tensioning rollers 104*a* and 104*b***.

The sheet is decelerated in an initial slow down stage by a plurality of snubber assemblies 154. The upper snubber assemblies 154, like the lower snubber assemblies, comprise a curved snubber arc 163 and counterbalance weight member 164 mounted on snubber support plates 167. The lower, intermediate speed belts 120, against which the upper snubber assemblies 154 trap and decelerate the sheets, traverse idler rollers 169 and drive rollers 171. The lower, intermediate speed belts 120 are subject to continuous tensioning by belt tensioning member 173 through tensioning rollers **173*a* and 173*b***.

A sheet exiting the initial deceleration stage promptly enters the second deceleration and shingling stage. The second deceleration stage includes a pair of upper, intermediate speed belts 220 having a portion disposed above the lower intermediate speed belts 120. The upper intermediate speed belts 220 traverse a pair of adjusting rollers 206 and a pair of drive rollers 258. As seen in FIG. 2, adjusting rollers 207 are positionable by arm 210 about a pivot 212 to create an adjustable nip between upper, intermediate speed belts 220 and lower, intermediate belts 120. A belt tensioning member 244 provides tension for intermediate speed belts 120 through tensioning rollers **244*a* and 244*b***.

The second deceleration and shingling stage includes snubber assemblies 222. The snubber assemblies 222, like the lower snubber assemblies 223, comprise two rotatably mounted snubber wheels 224 and 226 rotatably mounted on the snubber support plates 230. The lower, low-speed belts 228, against which the snubber assemblies 222 trap and decelerate the sheets, traverse idler rollers 246 and drive rollers 248. A belt tensioning member 242 provides tension to low-speed belts 228 through tensioning rollers **242*a* and 242*b*. Additionally, squaring rollers 234 disposed at the downstream end of arm 250 straighten the sheet and press the front edge of the sheet onto low speed belts 228. As in the lower delivery system, positioning rollers (not shown) cooperate with upper, intermediate speed belts 220 to provide vertical adjustable positioning of the intermediate speed belts 220**.

Figure 8:
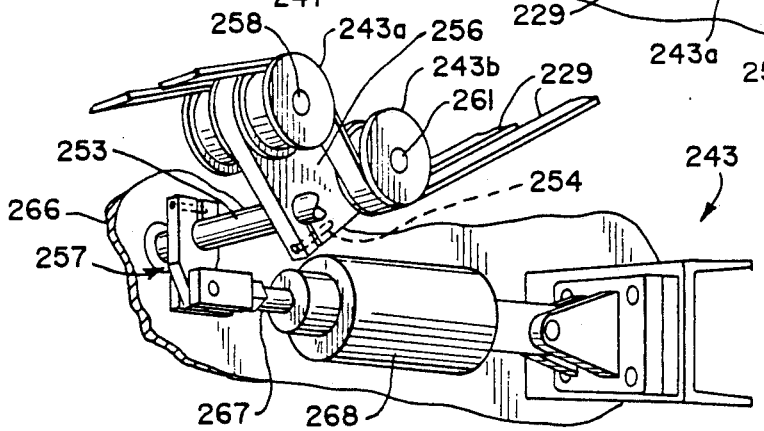
FIG. 8 is a perspective view of a uniform multiple belt tensioner in accordance with the present invention.

Referring now to FIGS. 7 and 8, the multiple belt tensioning member 243 for low speed belts 229 is shown. Tensioning member 243 comprises two pairs of roller means, shown as rollers 243*a* and 243*b*. Rollers 243*a* and 243*b* are rotatably mounted about axles 258 and 261 which, in turn, are mounted on a triangular shaped mounting bracket 256. Bracket 256 is adjustably mounted to a shaft 253 by a locking screw 254 which causes the bracket 256 to grip the shaft 253. Shaft 253 is rotatably mounted to the frame 266 of the system with the use of suitable bearing means. Further, a tensioning arm 267 which is part of pneumatic piston 268 is mounted to shaft 253 with the use of a bracket 257. Bracket 257 adjustably grips shaft 253 in the same manner as bracket 256 grips shaft 253. Tensioning arm 267 is preferably mounted to the center of shaft 253 but may be mounted anywhere along shaft 253 as space requirements dictate.

In operation, the pairs of rollers 243*a* and 243*b* are positioned on opposite sides of belts 229 at spaced locations. As arm 267 is extended, mounting bracket 256 rotates in a clockwise direction, providing increased tension to belts 229 through rollers 243*a* and 243*b*. Belt tensioning member 243 thereby applies uniform tension to belts 229 with the use of a single tensioning arm 267. Multiple belt tensioners 104, 105, 109, 133, 151, 173, 242, 244 and 245 operate in a similar manner.

While the above description only shows one embodiment of the invention, the invention is not limited thereto since one may make modification, and other embodiments of the principles of this invention will occur to those skilled in the art to which the invention pertains, particularly upon considering the foregoing teachings. For example, the delivery system could be used in any environment where the sheets are fed in a spaced apart format.

What is claimed is:

1. A sheet handling system for receiving a stream of regularly spaced apart sheets provided by a sheet processing apparatus along a travel path at an original speed and for decelerating the sheets, all while maintaining substantially continuous control of the sheets, comprising:

first conveyor means disposed downstream of the sheet processing apparatus including a first conveying surface dropped relative to the sheet travel path operating at a speed less than the original speed;

snubbing means disposed near the upstream end of said first conveyor means for applying a continuous uniform pressure to positively control the sheets to trap each of the sheets against said first conveying surface so that each sheet is decelerated to the speed of said first conveying surface, said snubbing means timed with respect to the arrival of the sheets so that each sheet is trapped against said first conveying surface substantially immediately as the tail of the sheet exits the sheet processing apparatus so that the sheet is not in free flight for any significant interval when the tail of the sheet exits the sheet processing apparatus; and second conveyor means disposed relative to said first conveyor means including a second conveying surface operating at a speed substantially the same as said first conveying surface, said second conveying surface closely spaced from said first conveying surface along at least a portion to form a nip therebetween to positively control the lead edge of the sheet before the tail of the sheet is disengaged by said snubbing means.

2. The sheet handling system of claim 1, wherein the snubbing means is timed with respect to the arrival of the sheets so that a sheet is trapped against said conveying surface just before the tail of the sheet exits the sheet processing apparatus.

3. The sheet handling system of claim 1, wherein the snubbing means comprises a plurality of aligned snubber arcs rigidly mounted on a common axis of rotation, each of said snubber arcs having a sheet contacting surface of uniform radial distance from the center of said axis, said axis positioned in overlying relation to said first conveying surface and being operated to rotate said sheet contact surfaces at a speed less than the speed of the sheets exiting the sheet processing apparatus.

4. The sheet handling system of claim 3, wherein said snubbing means further includes counterbalance weight members mounted on said axis and spaced 180° apart from said snubber arcs.

5. The sheet handling system of claim 1, wherein said snubbing means includes a plurality of aligned snubber rollers mounted on a common axis of rotation, said axis positioned in overlying relation to said first conveying surface, said snubber rollers mounted on said axis in pairs, spaced 180° apart, timed with the arrival of the sheets to alternately engage each successive sheet and direct the sheet toward said first conveying surface.

6. A sheet handling system for receiving a stream of regularly spaced apart sheets provided by a sheet processing apparatus along a travel path at an original speed, decelerating the sheets through at least two slow down stages, and placing the sheets in shingled format, all while maintaining substantially continuous control of the sheets, comprising:

first conveyor means disposed downstream of the sheet processing apparatus including a first conveying surface dropped relative to the sheet travel path operating at a speed less than the original speed;

first snubbing means disposed near the upstream end of said first conveyor means for applying a continuous uniform pressure to positively control the sheets to trap each of the sheets against said first conveying surface so that each sheet is decelerated to the speed of said first conveying surface, said first snubbing means timed with respect to the arrival of the sheets so that each sheet is trapped against said first conveying surface substantially immediately as the tail of the sheet exists the sheet processing apparatus so that the sheet is not in free flight for any significant interval;

second conveyor means disposed relative to said first conveyor means including a second conveying surface operating at a speed substantially the same as said first conveying surface, said second conveying surface closely spaced from said first conveying surface along at least a portion for forming a nip therebetween to control the lead edge of the sheet before the tail of the sheet is disengaged by said first snubbing means;

third conveyor means positioned downstream of said nip including a third conveying surface dropped relative tot he sheet travel path operating at a speed less than said first conveying surface; and second snubbing means positioned near the upstream end of said third conveyor means for applying a continuous uniform pressure to positively control the sheets and for trapping each of the sheet exiting said nip so that each sheet is decelerated to the speed of said third conveyor surface, said second snubbing means timed with respect to the arrival of the sheets so that each sheet is trapped against said third conveying surface substantially immediately as the tail of the sheet exits said nip and after the lead edge of the sheet has overlapped the preceding sheet to maintain substantially continuous control of the sheets so as to prevent damage or misalignment of the sheets.

7. The sheet handling system of claim 6, wherein said first snubbing means is timed with respect to the arrival of the sheets so that a sheet is trapped against said first conveying surface just before the tail of the sheet exits the sheet processing apparatus.

8. The sheet handling system of claim 6, wherein said first snubbing means comprises a plurality of aligned first snubber arcs rigidly mounted on a first common axis for rotation, each of said first snubber arcs having a sheet contacting surface of uniform radial distance from the center of said first axis, said first axis positioned in overlying relation to said first sheet path conveying surface and being operated to rotate said sheet contacting surfaces at a speed less than the speed of the sheets exiting the sheet processing apparatus.

9. The sheet handling system of claim 8, wherein said snubbing means further includes counterbalance weight members mounted on said axis and spaced 180° apart from said snubber arcs.

10. The sheeting handling system of claim 6, wherein said first snubbing means includes a plurality of aligned snubber rollers mounted on a first axis of rotation, said axis positioned in overlying relation to said first conveying surface, said snubber rollers mounted on said first axis in pairs, spaced 180° apart, and timed with the arrival of the sheets alternately to engage each successive sheet and direct the sheet toward said first conveying surface.

11. The sheet handling system of claim 6, wherein said second snubbing means is timed with respect to the arrival of the sheets so that each sheet is trapped against said second conveying surface just before the tail of the sheet exits said first conveyor system.

12. The sheet handling system of claim 6, wherein said second snubbing means comprises a plurality of aligned second snubber arcs rigidly mounted on a second axis for rotation, each of said second snubber arcs having a sheet contacting surface of uniform radial distance from the center of said second axis, said second axis positioned in overlying relation to said third conveying surface and being operated to rotate said sheet contacting surfaces at a speed less than the speed of the sheets exiting said nip.

13. The sheet handling system of claim 6, wherein said second snubbing means includes a plurality of aligned snubber rollers mounted on a second axis for rotation, said axis positioned in overlying relation to said third conveying surface, said snubber rollers mounted on said second axis in pairs, spaced 180° apart, and timed with the arrival of the sheets to alternately engage each successive sheet and direct the sheet toward said third conveying surface.

* * * * *